US009631491B2

(12) United States Patent
Lumb

(10) Patent No.: US 9,631,491 B2
(45) Date of Patent: Apr. 25, 2017

(54) APPARATUS FOR FORMING AN UNDERGROUND TUNNEL

(75) Inventor: Matthew Lumb, Darlington (AU)

(73) Assignees: Hilary Leith Lumb (AU); Leith Norma Morgan (NZ); James Edward Morgan (NZ)

( * ) Notice: Subject to any disclaimer, the term of this patent is extended or adjusted under 35 U.S.C. 154(b) by 411 days.

(21) Appl. No.: 12/808,654

(22) PCT Filed: Dec. 17, 2008

(86) PCT No.: PCT/AU2008/001850

§ 371 (c)(1),
(2), (4) Date: Sep. 7, 2010

(87) PCT Pub. No.: WO2009/076710

PCT Pub. Date: Jun. 25, 2009

(65) Prior Publication Data

US 2013/0193744 A1 Aug. 1, 2013

(30) Foreign Application Priority Data

Dec. 17, 2007 (AU) ..... 2007906904

(51) Int. Cl.
*E21D 9/10* (2006.01)
*E21D 15/44* (2006.01)
(Continued)

(52) U.S. Cl.
CPC ..... *E21D 9/1006* (2013.01); *E21D 9/1013* (2013.01); *E21D 9/12* (2013.01);
(Continued)

(58) Field of Classification Search
CPC ... E21D 9/1006; E21D 9/1013; E21D 9/1033; E21D 15/44; E21D 23/088; E21D 21/00
(Continued)

(56) References Cited

U.S. PATENT DOCUMENTS 1,736,853 A * 11/1929 Fisher ..... 299/74
2,862,604 A 12/1958 Craggs et al.
(Continued)

FOREIGN PATENT DOCUMENTS

WO 2004/027215 A1 4/2004

OTHER PUBLICATIONS

International Search Report from PCT Application No. PCT/AU2008/001850 dated Feb. 25, 2009 (3 pages).
(Continued)

*Primary Examiner* — John Kreck
*Assistant Examiner* — Michael Goodwin
(74) *Attorney, Agent, or Firm* — Kilpatrick Townsend & Stockton LLP

(57) ABSTRACT

The present disclosure provides an apparatus for forming an underground tunnel. The apparatus comprises a cutting head for removing material from a wall portion of the tunnel and thereby forming a portion of the tunnel. Further, the apparatus comprises a support structure for supporting a previously formed portion of the tunnel. The support structure is arranged to provide a supporting force against a surface of the tunnel when stationary and when being moved along the tunnel. Further, the apparatus comprises a conveyor for conveying removed material from the cutting head to a location remote from the cutting head during formation of the portion of the tunnel.

18 Claims, 4 Drawing Sheets

(51) Int. Cl.

| | |
|---|---|
| ***E21D 21/00*** | (2006.01) |
| ***E21D 23/00*** | (2006.01) |
| ***E21D 9/12*** | (2006.01) |
| ***E21D 19/04*** | (2006.01) |
| *E21D 23/08* | (2006.01) |

(52) U.S. Cl.
CPC ..... *E21D 15/44* (2013.01); *E21D 19/04* (2013.01); *E21D 21/00* (2013.01); *E21D 23/0052* (2013.01); *E21D 23/088* (2013.01)

(58) Field of Classification Search
USPC ..... 299/11, 31, 33, 64, 65, 67; 405/298
See application file for complete search history.

(56) References Cited

U.S. PATENT DOCUMENTS

| | | | | |
|---|---|---|---|---|
| 2,899,800 | A * | 8/1959 | Joy | 405/298 |
| 3,879,088 | A * | 4/1975 | Sodder et al. | 299/31 |
| 3,907,366 | A * | 9/1975 | Pender | 299/18 |
| 4,114,385 | A * | 9/1978 | Valantin | 405/298 |
| 4,122,683 | A | 10/1978 | Follert et al. | |
| 4,129,990 | A * | 12/1978 | Valantin | 405/299 |
| 4,199,193 | A * | 4/1980 | Damron et al. | 299/31 |
| 4,226,476 | A * | 10/1980 | Fairchild et al. | 299/31 |
| 4,348,138 | A * | 9/1982 | Blampain et al. | 405/297 |
| 4,362,337 | A * | 12/1982 | Casanova | 299/31 |
| 5,253,925 | A | 10/1993 | Modzik, Jr. | |
| 5,333,936 | A * | 8/1994 | Zitz | 299/64 |
| 5,527,099 | A | 6/1996 | Fikse | |
| 5,816,750 | A | 10/1998 | Steffenino | |
| 5,915,790 | A | 6/1999 | Sakai et al. | |
| 6,206,478 | B1 | 3/2001 | Uehara et al. | |
| 6,726,849 | B2 | 4/2004 | Gay et al. | |

OTHER PUBLICATIONS

Extended European Search Report from European Application No. 08862215.4 dated Feb. 27, 2013 (6 pages).
Australian Examination Report from Australian Application No. 2008338242 dated Feb. 20, 2014 (4 pages).

* cited by examiner

APPARATUS FOR FORMING AN UNDERGROUND TUNNEL

CROSS REFERENCE TO RELATED APPLICATIONS

This application is a National Stage of International Application No. PCT/AU2008/001850 filed Dec. 17, 2008, and which claims the benefit of Australian Patent Applications Nos. 2007906904, filed Dec. 17, 2007, and 2008900022, filed Jan. 3, 2008, the disclosures of which are incorporated herein by reference.

FIELD OF THE INVENTION

The present invention relates to an apparatus for forming an underground tunnel.

BACKGROUND OF THE INVENTION

Structures for supporting the inner surface of a mining tunnel, particularly the roof, have been used for some time. These structures prevent tunnels from caving-in due to forces exerted on the tunnel by the surrounding environment.

A section of the tunnel is cut by a cutting head, which is then stopped and the support structure is erected. Consequently, typical machinery for cutting mining tunnels operates in a "start-stop" fashion.

The start-stop procedure of driving a tunnel continues as the tunnel is being progressed. Positioning and adjusting of existing support structures is also required and can be very time consuming.

Further, the accumulation of cut material in the tunnel also slows down the cutting of the tunnel. Once a section of the tunnel is cut, the cutting machinery is stopped and the accumulated cut material is moved away.

There is a need for technological advancement.

SUMMARY OF THE INVENTION

The present invention provides in a first aspect an apparatus for forming an underground tunnel, the apparatus comprising:

- a cutting head for removing material from an end-face of the tunnel and thereby forming a further portion of the tunnel;
- a member coupled to the cutting head and arranged to push the cutting head against the end-face of the tunnel during removal of the material;
- a support structure for supporting a previously formed portion of the tunnel by providing a supporting force against a surface of the tunnel, the support structure being arranged to move along the tunnel while maintaining the supporting force during formation of the further portion of the tunnel; and
- a conveyor for conveying removed material to a location remote from the cutting head during formation of the further portion of the tunnel;
- wherein the cutting head is movable during removal of the material in a direction into the tunnel and the support structure is arranged to move into the tunnel in response to and during progression of the tunnel.

Throughout this specification the term "cutting head" is used to refer broadly to a head that is arranged for removing the material by drilling, grinding, cutting, or any other suitable technique.

Throughout this specification the term "tunnel" is used for any type of tunnel also including a branch tunnel, such a tunnel that branches off another tunnel.

The underground tunnel typically is not in an open pit environment however the tunnel may commence in an open pit environment and may be located many tens, a hundred or even more meters below a ground plane. The tunnel may for example be a roadway. The tunnel may be formed in hard earth, rock, coal or an ore.

The apparatus typically is arranged to form a tunnel having a cross-sectional area of the order of 10 to 25 $m^2$.

The member may comprise a hydraulic arrangement and typically is provided in the form of a "push beam". The member typically comprises an anchoring structure that in use provides a basis for pushing the cutting head against the end-face of the tunnel. Alternatively, the support structure may comprise a mount for mounting the member.

The member typically is arranged so that the cutting head is movable independently from the support structure in a direction along the underground tunnel.

The apparatus typically is arranged so that in use the support structure, or a portion thereof, during removal of the material by the cutting head, is movable to a position immediately behind a coupling of the cutting head, typically within 0.5-5 m of the cutting head, without restricting movement of the cutting head in a direction that is transversal to a direction of movement of the support structure or the portion thereof.

In one specific embodiment the conveyor is arranged to enable conveying of the removed material along the tunnel to a suitable location in a manner such that inhibiting of formation of the portion of the tunnel, or the entire tunnel, due to accumulated removed material is avoided.

The support structure typically comprises a void area through which in use the removed material is transported. In one example, a portion of the member and/or a portion of the conveyor are positioned within the void area.

The apparatus typically is arranged so that in use removed material is continuously conveyed away from the cutting head.

The support structure may comprise a plurality of supporting parts, such as a series of the supporting parts. Each supporting part typically is arranged to exert a supporting force and move along the surface in a manner such that the supporting force is maintained during movement relative to the surface of the tunnel.

Each supporting part typically comprises a drive and typically is drivable, either automatically controlled by a distance measurement device or manually controlled by a driver.

The apparatus may comprise a device for placing support bolts. Further, the apparatus may be arranged so that the formation of the tunnel does not have to be interrupted for the placement of the bolts. Each support part typically is arranged so that support bolts may be placed at or near the location of the support part and during movement of the support part.

The supporting parts typically are spaced apart from each other at a distance which permits support bolts to pass there between.

Throughout this specification, the term "bolt" (and variations thereof) is used to refer to a member, such as a steel member, that is put in place to provide a permanent support for the surface of the tunnel.

The apparatus according to embodiments of the present invention provides a supporting force, conveys material away from the cutting head and is arranged for placing support bolts during formation of the tunnel and during movement of the apparatus along the tunnel. Consequently, time delay associated with the "start-stop" progression technique of known apparatus can be avoided or reduced and the apparatus according to embodiments of the present invention enables formation of the tunnel at relatively high average speed.

The apparatus may comprise a coupling that couples the cutting head to a portion of the apparatus, typically the member, and that comprises an arrangement, such as a hydraulic arrangement, that enables pivoting the cutting head relative to the portion of the apparatus.

The apparatus may be arranged for pivoting the cutting head in a horizontal plane. In addition, the apparatus may be arranged for pivoting the cutting head in a vertical plane or in any other plane. Consequently, the apparatus according to an embodiment of the present invention provides the advantage that non-straight sections of the tunnel can be formed.

The conveyor typically comprises conveyor elements that are movable relative to each other and typically are pivotable relative to each other. For example, a first conveyor element may comprise a portion that overlaps a portion of an adjacent second conveyor element and that is in use positioned behind the first conveyor element during forming of the tunnel. In one specific embodiment the conveyor comprises a series of conveyor elements and each conveyor element has a portion that is overlapped with a portion of an adjacent conveyor element.

In one specific embodiment of the present invention the apparatus comprises machinery for operating the cutting head and is arranged so that at least a portion of the machinery for operating the cutting head is in use positioned at a location remote to the cutting head, for example at a distance of up to 5 m, 10 m, 50 m, 100 m or more along the tunnel behind the cutting head.

In one example, the cutting head is driven by a hydraulic motor or an electric motor that may be positioned in or adjacent the cutting head. A device for generating the hydraulic pressure for operating the hydraulic motor and/or the hydraulic arrangement for pushing the cutting head typically is in use positioned at the position remote from the cutting head, such as 5 m, 10 m, 50 m, 100 m or more along the tunnel behind the cutting head. Consequently, the apparatus according to embodiments of the present invention provides the advantage of increased space at the cutting head or immediately behind the cutting head, which further reduces the probability that accumulated cut material requires a "stop" during formation of the tunnel thus increasing space to facilitate use of higher efficiency driving equipment including automatic bolters.

Each of the supporting parts may comprise spaced apart wheels, a belt mounted on the wheels and guides arranged to retain the belt on the wheels. The support structure may be arranged to exert the supporting force against a roof and/or a side of the tunnel.

The member may comprise an interior that is enclosed at side and top portions and may also comprise a closed bottom portion. The member may be arranged for conveying cut material away from the cutting head through the interior of the member.

The apparatus may comprise a ventilation system that uses the member as a duct for sucking or blowing gases and dust from a workplace or cutting face and wherein the apparatus may be arranged for ventilating a workplace using the ventilation system.

The apparatus may be arranged for introducing explosion prevention materials into the interior of the member during conveying of the cut material through the interior of the member.

The apparatus may comprise a steering unit for steering at least one of the cutting head, the member and a pushing unit for pushing the member.

The present invention provides in a second aspect a method of forming an underground tunnel, the method comprising:

- pushing a cutting head against an end-face of the underground tunnel;
- removing material from the end-face of the underground tunnel using the cutting head and thereby forming a further portion of the underground tunnel;
- moving the cutting head into the tunnel as formation of the tunnel progresses;
- supporting a previously formed portion of the underground tunnel using a support structure, the support structure being arranged to provide a supporting force during movement of the support structure along the tunnel;
- moving the support structure along the tunnel during removal of the material by the cutting head; and
- conveying removed material to a location remote from the cutting head during formation of the underground tunnel.

The movement of the cutting head typically is independent from the movement of the support structure The method typically comprises pushing the cutting head against the end-face of the underground tunnel using a member, such a as a push beam, that may be anchored at the tunnel. The method typically comprises moving the cutting head relative to an anchoring of the member using a hydraulic arrangement.

The method typically comprises moving the support structure, or a portion thereof, during removal of the material by the cutting head so that a portion of the support structure is positioned immediately behind a coupling of the cutting head, typically within 0.5-5 m of the cutting head, without restricting movement of the cutting head in a direction that is transversal to direction of movement of the support structure or the portion thereof. This step typically comprises checking a location of the cutting head relative to the support structure, or a part thereof, and driving at least a portion of the support structure during removal of the material by the cutting head so that the support structure is positioned immediately behind a coupling of the cutting head without restricting movement of the cutting head in a direction that is transversal to direction of movement of the support structure.

Checking the location of the cutting head may be performed visually or with the aid of a distance measurement device.

The method typically comprises placing support bolts during movement of at least a portion of the support structure and during removal of the material by the cutting head in a manner such that formation of the tunnel does not have to be interrupted for the placement of the bolts.

The method may also comprise the step of extending the conveyor during advancement of the portion of the tunnel.

The method typically comprises the additional step of extending an effective length of a conveyor during conveying of removed material by that conveyor. This additional step typically is conducted so that formation of the tunnel is possible without interruption and during extension of the length of the conveyor.

Extending the effective length of the conveyor typically comprises extending the path-length of a conveyor belt along a portion of a conveyor belt loop at which the conveyor belt in use does not convey removed material.

For example, the step of extending the effective length of the conveyor may comprise tilting guiding idlers at a top conveyor strand at an end-portion of the conveyor so that the conveyor belt has a trough-like cross-sectional shape at the end-portion and a reduced width, which facilitates access and positioning of additional guiding elements required for the extension of the effective length of the conveyor.

In one embodiment the method comprises ventilating a workplace, such as a workplace positioned on the member, using a ventilation system that uses the member as a duct for sucking or blowing gases and dust from the workplace.

The method may also comprise introducing an explosion preventing medium into the interior of the member.

The member may have an interior that is enclosed at side and top portions and the method may comprise conveying material from the cutting head through the interior of the member.

The method may comprise using the member as a working platform.

The method may also comprise steering at least one of the cutting head, the member and a pushing unit.

The invention will be more fully understood from the following description of specific embodiments of the invention. The description is provided with reference to the accompanying drawings.

DETAILED DESCRIPTION OF SPECIFIC EMBODIMENTS

Figure 1:
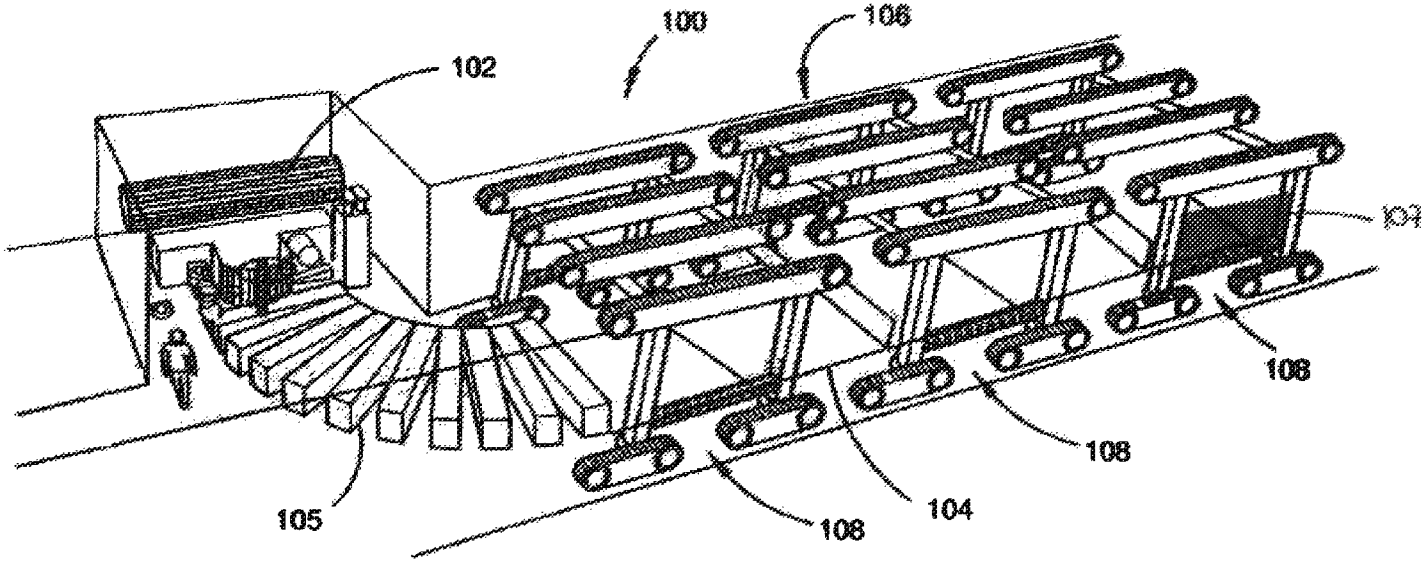
FIG. 1 illustrates an apparatus for forming an underground tunnel according to a specific embodiment of the present invention.

Referring initially to FIG. 1, an apparatus and a method for forming an underground tunnel according a specific embodiment of the present invention are now described. In this embodiment the tunnel is formed in an underground environment and may form a part of a mine.

FIG. 1 shows the apparatus 100 comprising a cutting head 102 for removing material from an end-face of the tunnel and thereby advancing the tunnel. The end-face may comprise hard earth, rock or an ore. In this embodiment the cutting head 102 is arranged for removing the material by grinding. Alternatively, the cutting head 102 may be arranged for removing the material by cutting, drilling or any other suitable technique.

The apparatus 100 also comprises a push-beam 104 with coupling 105 and a support structure 106. The cutting head 102 is coupled to the push beam 104 by the coupling 105 so that the cutting head 102 can be moved in horizontal and vertical directions. Consequently, the apparatus 100 is arranged for forming tunnels having bent portions. When the apparatus is positioned in a tunnel portion for advancement of the tunnel, mechanisms and controls for the steering of the apparatus can be added along the length of the push beams, at a pushing station or at the cutting head at the face.

An end-portion of the push beam 104 is anchored into a wall portion of the tunnel to provide a basis for pushing the cutting head 102 against the end-face of the tunnel during removal of the material. The push beam 104 comprises a hydraulic arrangement that allows movement of cutting head into the tunnel while the tunnel advances. When the tunnel is advanced to a predetermined depth, the push beam is removed from the anchoring and re-anchored at a position deeper in the tunnel. The hydraulic arrangement is initially retracted so that a further tunnel portion may be formed without interruption using the hydraulic arrangement and moving the support structure 106 accordingly.

In a variation of the described embodiment the push beam 104 may also be anchored at one of the support structure 106. However, in any case the push beam typically is arranged so that the cutting head 102 and the support structures 106 are movable independently.

In this embodiment the cutting head 102 comprises an electric motor. Alternatively, the cutting head may comprise a hydraulic motor. A device for generating the hydraulic pressure for operating the hydraulic motor and/or the hydraulic arrangement of the push beam 104 is located at a position remote from the cutting head 102, such as at a suitable location behind the support structure 106.

The push beam 104 is positioned within the support structure 106 and comprises an outer housing within which two augers or other conveying devices such as a belt or chain conveyor are positioned. The apparatus 100 also comprises a conveyer (not shown in FIG. 1) that is arranged to convey material that was removed by the cutting head 102. The removed material is collected from an end-portion of the push beam 104.

The push beam 104 provides a rigid structure that transfers a force required to push the cutting head against an uncut face of the tunnel and thereby, with the rotation of the cutting head, excavate at the uncut face area. The push beam 104 also acts as a dead weight to pull a pushing mechanism and the overlap structure at the end of the belt conveyor forward to allow it to be reset. Further, the push beam 104 is arranged to provide a safe enclosure for enclosing a mineral conveying system positioned in the push beam 104 to prevent harm to persons working in the area. The push beam 104 also provides a sturdy base for the addition of a potential dedicated robust ventilation duct within the push beam 104 with means to allow the periodical or continuous addition of explosion suppressant material such as stone dust. Further, the push beam 104 is arranged for mounting of ventilation fans (where necessary), adapters and scrubbing equipment to create a safe work environment.

The support structure 106 comprises support parts 108. Each support part 108 is arranged to support a roof and side portions of the formed tunnel and for moving behind the cutting head 102 in a manner such that a supported force is maintained during the movement. The support parts 108 will be described in further detail below with reference to FIG. 4.

Further, the apparatus 100 comprises a device for placing bolts (not shown in FIG. 1). The bolts are placed in wall portions of the formed tunnel and are arranged to provide sufficient support if the support parts 108 have moved past a formed portion of the tunnel and consequently no longer provide the supporting force. Each support part 108 is arranged so that support bolts may be placed during movement of the support part 108.

The apparatus 100 has the advantage that the support structure 106 provides a supporting force during movement of the support structure 106. Bolts can be positioned during advancement of the tunnel and the material that is removed by the cutting head 102 is continuously conveyed away from the cutting head 102. Further, the apparatus 100 is arranged so that at least a portion of the machinery for operation 107 of the cutting head 102, such as the drive that provides the hydraulic pressure for the hydraulic arrangement of the push beam 104, is located remote from the cutting head 102 so that the available space at the cutting head 102 is increased. Consequently, the apparatus 100 according to an embodiment of the present invention has the significant commercial advantage that at least for the formation of a straight section "start-stop" operation of the apparatus 100 can be avoided or reduced and the tunnel can be formed at a relatively high average speed.

For formation of bent tunnel portions the advancement of the tunnel may be interrupted for a short period of time until the support part are moved along a bent portion of the tunnel. Alternatively, the support parts 108 may also be arranged to move around the bend during operation of the cutting head 102 and while maintaining the supporting force to support the roof. For example, the elements 108 may be arranged so that, if they also support for side-portions of the tunnel, momentarily the side supporting elements are retracted to reduce the width of the support parts 108 and enable movement of the support parts 108 around the bend.

Figure 2:
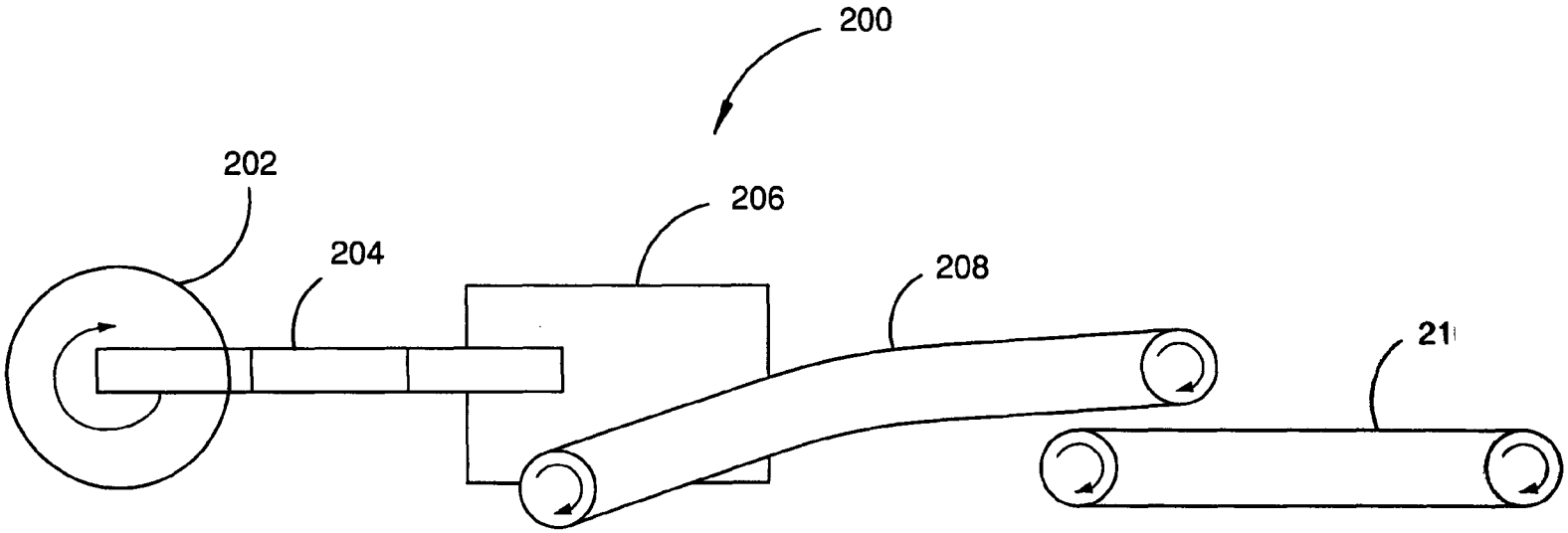
FIG. 2 illustrates an apparatus for forming an underground tunnel according to a further embodiment of the present invention.

FIG. 2 shows a schematic illustration of the components of the apparatus for forming an underground tunnel. The shown apparatus 200 comprises a cutting head 202 for removing the material and a push beam 204 for supporting the cutting head 202 and moving material away from the cutting head 202. Further, the apparatus 200 comprises a means for steering the push beam (not shown) and pushing the push beam 204 in a forward direction. A conveyer element 208 is arranged to collect the removed material from the push beam 204 and to covey the collected removed material to another conveyer element 210. In this embodiment, a portion of the push beam 204 penetrates through a support structure (not shown), such as the support structure 106 illustrated in FIG. 1.

The support 206 is arranged for anchoring in the tunnel to provide a basis for pushing the cutting head 202 against the end-face of the tunnel. The support 206 comprises anchoring means, for example provided in the form of suitable hydraulic jacks, which secure the support 206 relative to wall portion of the tunnel. Once the cutting head 202 and push beam 204 have advanced as far as possible, then an arrangement for releasing the anchoring means and moving the support structure 206 with the anchoring means along the tunnel is used. The arrangement for releasing the anchoring means and moving support structure 206 may comprise alternately operable pairs of hydraulic rams clamping to the wall, floor or roof portions of the tunnel.

The arrangement for releasing the anchoring means and moving the support structure 206 may also comprise a means for the prevention of push beam lifting during times of excessive force being supplied from the pushing unit.

The conveyer elements 208 and 210 are movable relative to the push beam 204 and comprise overlapping portions. For example, the conveyor element 208 may be a chain conveyor and the conveyor element 210 may be a belt conveyor that may have a length much longer than the chain conveyor 208. The conveyor elements 208 and 210 are movable relative to each other about a vertical axis that this located at the overlapping region. In this case the conveyor elements 208 and 210 are arranged so that the removed material may be conveyed along a bent portion of the tunnel.

It is to be appreciated that in variations of the described embodiments the apparatus 200 may alternatively comprise only one conveyor element. Further, the apparatus 200 may comprise any number of conveyor elements that may or may not be movable relative to the push-beam 204.

The conveyor is arranged so that the conveyor can be extended during advancement of the tunnel by extending the length of the conveyor element 210.

The conveyor element 210 typically is arranged to provide sufficient space to enable operators to extend the conveyor element 210 during operation. For example, the conveyor element 210 may comprise idlers that guide a conveyor belt and that are adjustable. Such adjustable idlers may be positioned at the "outbye" tail ends of the conveyor element 210. The idlers may be adjusted so that at the outbye end the conveyor belt is directed over angled idlers so that the conveyor belt has a trough-like cross-sectional shape and a narrower footprint in the area where conveyor belt frames are to be installed. The narrower footprint provides space for placing additional support brackets and guiding members required for guiding an extended length of the conveyor belt.

As the cutting head 202 and the push beam 204 advance forward, the effective length of the conveyor belt is extended. For example, the effective length of the conveyor belt may be extended by releasing additional conveyor belt from a loop of conveyor belt of a device that is arranged to keep the tension of the conveyor belt largely constant. The deeper "troughing" idlers move forward with the conveyor belt tail end and the conveyor belt ramps down to run on the now installed conveyor belt frames. This set-up enables the extension of the effective conveyor belt length without interrupting the cutting process and during conveying of removed material.

A formed tunnel may have a length of a few hundred meters or even a few kilometers. The apparatus 200 may comprise a support structure, such as the support structure 106, which may comprise any number of support parts. The apparatus 200 may comprise any number of conveyer elements, such as conveyor elements 208 and 210, which are arranged so that each conveyer element overlaps the portion of an adjacent conveyer element whereby transport of removed material from one conveyer element to an adjacent conveyer element is facilitated.

The cutting of through-cuts between parallel tunnels (roadways) can be conducted using the apparatus 100 or 200 in the described manner. Alternatively, the apparatus 100 or 200 may also comprise an additional, usually shorter, push-beam and normally wider cutting head for cutting such through-cuts. For example, the additional push-beam and cutting head assembly may be mounted on the push beam 104. Hydraulic bolters or other types of bolters may be mounted on this unit to permanently support the roof and side-portions of the tunnel.

All ventilation and electrical and mechanical service devices can also be mounted on the push beam 104 or 204. Supply of consumables and any material that is used during operation of the apparatus 100 or 200 can be provided by monorail.

Guidance of the cutting head 102 head may for example be provided using a gamma-ray monitor to detect the roof and floor of the tunnel or using any other from of guidance system, for example a guidance system that is arranged for inertial guidance.

It is to be appreciated by a person skilled in the art that alternatively the conveyor may take any other suitable form.

Figure 3:
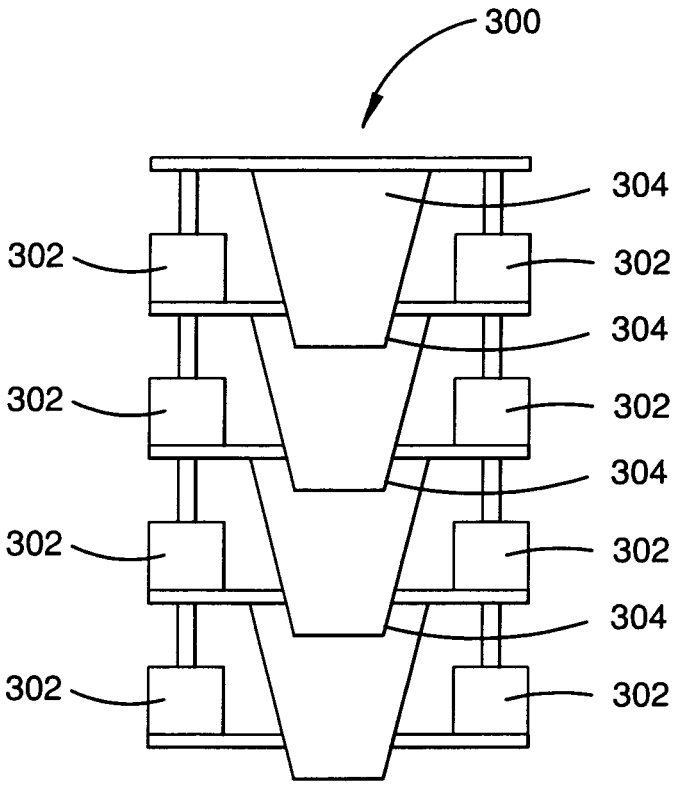
FIGS. 3 and 4 illustrate components of the apparatus for forming an underground tunnel according to a specific embodiment of the present invention.

FIG. 3 shows schematically a coupling 300 for coupling the cutting head, such as the cutting head 102 shown in FIG. 1, to the push-beam, such as the push-beam 104 also shown in FIG. 1. The coupling 300 comprises a plurality of sections 304 that are coupled by hydraulic elements 302 having a length that is controllable by a hydraulic pressure applied to the elements 302. By controlling the hydraulic pressure it is possible to bend the coupling 300 in a horizontal plane so that tunnels with left hand or right hand bends may be formed. The sections 304 have overlapping portions along which the removed material moves towards the push-beam. The coupling 300 also comprises a similar hydraulic arrangement that allows bending of the coupling 300 in a vertical direction (not shown in FIG. 3).

Figure 4:
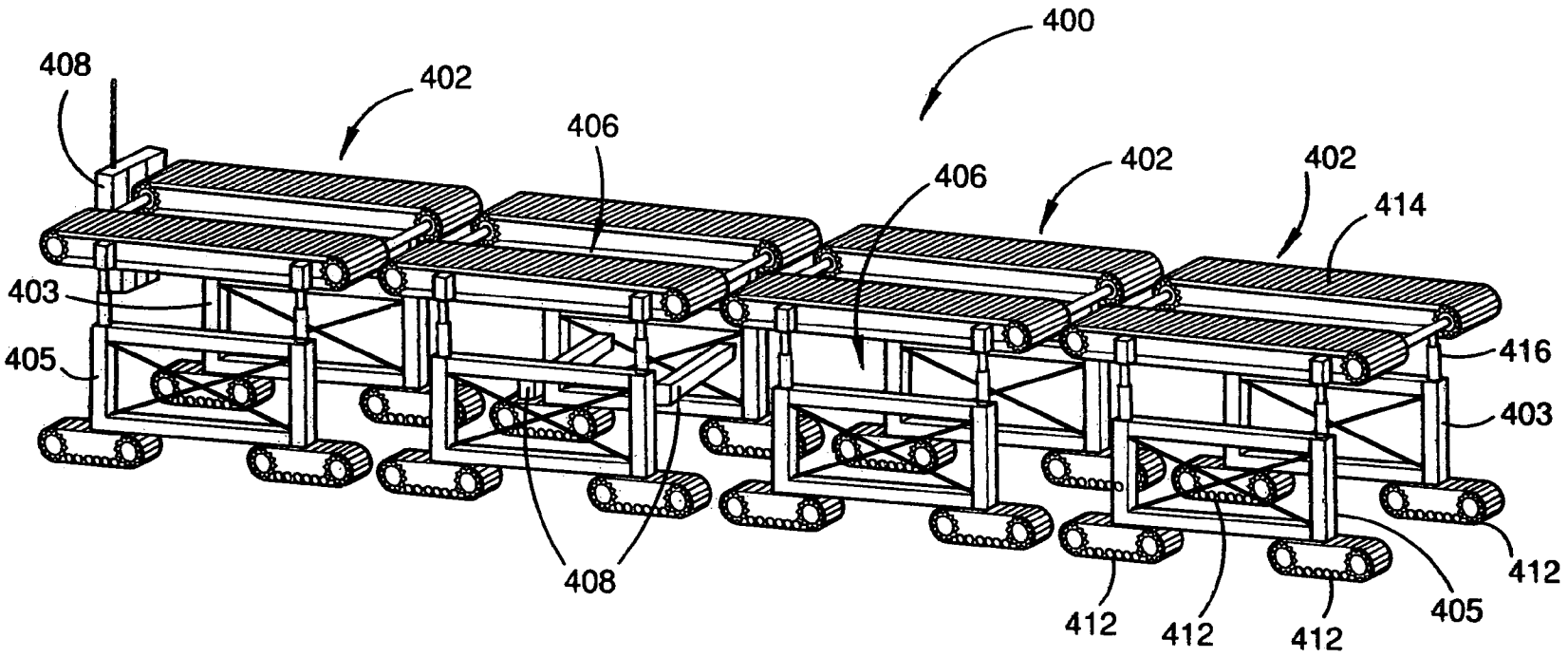

Referring now to FIG. 4, a support structure 400 is now described in further detail. For example, the support structure 400 may replace the support structure 106 shown in FIG. 1. The support structure 400 comprises support parts 402, which have frames that are made from a material that is capable of carrying the load that is exerted by the surface of the tunnel. The various parts of each support part 402 are welded and/or bolted together. The frames have two main spaced apart outer sections 403 and 405, which define a void 406 located therebetween. The void 406 is such that it is capable of housing the push beam a portion of the conveyor and other mining equipment.

The support structure 400 includes a bolting machine 408 for installing bolts into the tunnel surface as the support structure 400 moves along the tunnel. The machine 408 is arranged to install side and roof bolts independently. The machine 408 is mounted on rotary actuators (not shown) so that the position of the bolts can be varied as required.

The apparatus 400 has spaced apart portions 412 for placement on the floor of the tunnel, and which carry the support structure 400. As can be seen in FIG. 4, the spaced apart portions 412 are attached to the support parts 402 at the corners thereof. The apparatus 400 also has parts 414 that are located on top of the support structure 400 and which bear against the roof of the tunnel so as to exert a supporting force.

The space between parallel parts 414 is such that it can accommodate the end of bolts that have been installed into the roof so as to avoid contact between the parts 414 and the end of the bolts as the support structure 400 moves along the tunnel.

The portions 412 and 414 each include a belt that is mounted on spaced apart wheels. The belts and the wheels effectively form what is generally referred to as a 'caterpillar track', which is commonly found on many excavators and tanks. By using the belts mounted on the wheels, the portions 412 and 414 are able to readily move along the surface of the tunnel, thus permitting the apparatus 400 to be moved whilst supporting the surface of the tunnel.

The portions 412 and 414 comprise drives that are controllable by a driver. The support parts 412 and 414 are driven so that one of the portions 412 and 414 is positioned immediately behind a coupling of the cutting head 102, typically within 0.5-5 m of the cutting head, without restricting movement of the cutting head in a direction that is transversal to direction of movement of the support structure or the portion thereof. During operation the driver frequently checks how far the cutting head progresses and moves the portion 412 and 414 accordingly. One or more portions 412 and 414 typically follow. The support bolts are positioned during movement of the parts 412 and 414 so that the tunnel can be formed largely without interruptions.

The portions 414 also include accommodating means for allowing unevennesses which may be present in the surfaces of the tunnel to be accommodated. The accommodating means is provided by virtue of the belts being flexible.

Further details of the support structure are disclosed in PCT international application number PCT/AU2003/001251, which is hereby incorporated by cross-reference.

The reference that is being made to PCT international application number PCT/AU2003/001251 does not constitute an admission that the PCT international application number PCT/AU2003/001251 is part of the common general knowledge in Australia or any other country.

It is to be appreciated that the present invention may be provided in many different forms.

The invention claimed is:

1. An apparatus for forming an underground tunnel, the apparatus comprising:

a cutting head for removing material from an end-face of the tunnel and thereby forming a further portion of the tunnel, the cutting head comprising an electric or hydraulic motor;

machinery for operating the cutting head being at least partially positioned at a location remote from the cutting head;

a push beam providing a rigid structure arranged to push the cutting head against the end-face of the tunnel during removal of the material;

a coupling comprising a plurality of sections that are coupled by hydraulic elements, the sections being positioned between the hydraulic elements and the hydraulic elements being positioned to enable bending of the coupling between the cutting head and the push beam in a horizontal plane, the sections of the coupling comprising overlapping portions along which in use the removed material moves towards the push beam;

a support structure for supporting a previously formed portion of the tunnel by providing a supporting force against a surface of the tunnel, the support structure being arranged to move along the tunnel while maintaining the supporting force during formation of the further portion of the tunnel; and a conveyor for conveying removed material to a location remote from the cutting head during formation of the further portion of the tunnel;

wherein the apparatus is arranged, and at least a portion of the machinery is positioned, so that a space is provided at or immediately behind the cutting head so that the support structure, or a portion thereof, during removal of the material by the cutting head, is movable to a position immediately behind the cutting head, without restricting movement of the cutting head in a direction that is transversal to a direction of movement of the support structure or the portion thereof, and wherein the cutting head is movable independently from the support structure and during removal of the material away from the end-face of the tunnel and the support structure is arranged to move into the tunnel in response to and during progression of the tunnel.

2. The apparatus of claim 1 wherein at least a portion of the machinery is positioned at a location at least 10 meters behind the cutting head along the tunnel.

3. The apparatus of claim 1 wherein the push beam comprises an anchoring structure that in use provides a basis for pushing the cutting head against the end-face of the tunnel.

4. The apparatus of claim 1 wherein the apparatus is arranged so that in use the support structure, or a portion thereof, during removal of the material by the cutting head, is movable to a position within 0.5 meters to 5 meters behind the cutting head without restricting movement of the cutting head in a direction that is transversal to a direction of movement of the support structure or a portion thereof.

5. The apparatus of claim 1 wherein the conveyor is arranged to enable conveying of the removed material along the tunnel to a suitable location in a manner such that inhibiting of formation of the portion of the tunnel, or the entire tunnel, due to accumulated removed material is avoided.

6. The apparatus of claim 1 wherein the apparatus is arranged so that in use removed material is continuously conveyed away from the cutting head.

7. The apparatus of claim 1 wherein the support structure comprises a void area through which in use the removed material is transported and wherein a portion of the conveyor is positioned within the void area.

8. The apparatus of claim 7 wherein the support structure comprises a plurality of support parts and is arranged so that support bolts may be placed at or near the location of the plurality of supporting parts and during movement of the support structure.

9. The apparatus of claim 1 wherein the coupling comprises an arrangement that enables pivoting of the cutting head relative to a portion of the apparatus.

10. The apparatus of claim 1 wherein the apparatus is arranged for formation of non-straight sections of the tunnel.

11. A method of forming an underground tunnel, the method comprising:

pushing a cutting head against an end-face of the underground tunnel, the cutting head being coupled to a push beam by a coupling comprising a plurality of sections that are coupled by hydraulic elements, the sections being positioned between the hydraulic elements and the hydraulic elements being positioned to enable bending of the coupling between the cutting head and the push beam in a horizontal plane, the sections of the coupling comprising overlapping portions along which in use removed material moves towards the push beam;

moving the cutting head into the tunnel as formation of the tunnel progresses;

supporting a previously formed portion of the underground tunnel using a support structure, the support structure being arranged to provide a supporting force during movement of the support structure along the tunnel including a position immediately behind the cutting head without restricting movement of the cutting head in a direction that is transversal to a direction of movement of the support structure or a portion thereof;

moving the support structure along the tunnel during removal of material by the cutting head;

and conveying the removed material to a location remote from the cutting head during formation of the underground tunnel.

12. The method of claim 11 wherein the push beam is anchored at the tunnel at the support structure and wherein the method comprises moving the cutting head relative to an anchoring of the push beam.

13. The method of claim 11 comprising moving a portion of the support structure during removal of the material by the cutting head so that a portion of the support structure is positioned within 0.5 meters to 5 meters behind the cutting head.

14. The method of claim 11 further comprising placing support bolts during movement of at least a portion of the support structure and during removal of the material by the cutting head in a manner such that formation of the tunnel does not have to be interrupted for the placement of the bolts.

15. The method of claim 11 wherein the step of moving the support structure comprises checking a location of the cutting head relative to the support structure, or a part thereof, and driving at least a portion of the support structure during removal of the material by the cutting head so that the support structure is positioned immediately behind the cutting head without restricting movement of the cutting head in a direction that is transversal to direction of movement of the support structure.

16. The method of claim 11 further comprising extending a conveyor during advancement of the underground tunnel.

17. The method of claim 16 wherein the step of extending the conveyor extends an effective length of the conveyor and is conducted so that formation of the tunnel is possible without interruption and during extension of the effective length of the conveyor.

18. The apparatus of claim 1 comprising a bolting machine for placing support bolts and wherein the apparatus is arranged so that the formation of the tunnel does not have to be interrupted for the placement of the bolts.

* * * * *